United States Patent [19]

Belttary

[11] 4,393,288

[45] Jul. 12, 1983

[54] CIRCUIT BREAKER

[75] Inventor: Harold E. Belttary, Rio Piedras, P.R.

[73] Assignee: GTE Products Corporation, Stamford, Conn.

[21] Appl. No.: 276,574

[22] Filed: Jun. 23, 1981

[51] Int. Cl.[3] ..... H01H 33/08; H01H 33/10

[52] U.S. Cl. ..... 200/144 R; 200/147 R

[58] Field of Search ..... 200/144 R, 144 C, 147 R

[56] References Cited

U.S. PATENT DOCUMENTS

| | | | |
|---|---|---|---|
| 2,645,693 | 7/1953 | Cole et al. | 200/144 C |
| 2,816,990 | 12/1957 | Gelzheiser | 200/144 C |
| 2,898,427 | 8/1959 | Nadeau | 200/144 R |

*Primary Examiner*—Robert S. Macon

*Attorney, Agent, or Firm*—Fred Fisher

[57] ABSTRACT

An improved circuit breaker utilizing the combination of a pair of composition sheets and a channel. The sheets reside alongside opposing interior surfaces of a molded insulated housing and are held in place within recesses formed therein. The sheets are formed of material comprising a water-insoluble binder and an arc-suppressing substances selected from the class consisting of the oxides and hydrates of aluminum and magnesium, the binder constituting at least ten percent of the composition. The channel comprises an integral, generally U-shaped member forming a base and opposing side walls. One end of the side walls has extending widths to provide enlarged surfaces for engaging the composition sheets. Both ends of the base are formed with a tab for engaging a molded feature within the circuit breaker housing. The tabs and the composition sheets space the channel away from the interior surfaces of the housing, thereby exposing surfaces of the channel not in contact with the sheets. The base has venting holes. The sheets physically contact the extending widths of the channel, but do not physically engage a majority of the length of the channel. The sheets, in addition to having arc suppression characteristics, support the channel away from the molded housing, and thermally insulate the channel from the housing.

9 Claims, 7 Drawing Figures

CIRCUIT BREAKER

BACKGROUND OF THE INVENTION

1. Field of the Invention

This invention relates to circuit breakers of the type described in United States Patent No. 3,114,023, issued Dec. 10, 1963 to R. E. Locher. In particular, this invention relates to an electric arc cooling and quenching means for use in such breakers, such as a combination of a pair of composition sheets and a channel for providing electric arc cooling and quenching therefor. Accordingly, it is a general object of this invention to provide new and improved cooling and quenching means of such character.

2. Description of the Prior Art

Circuit breakers of the type described in the foregoing patent are often referred to as minimum modulus because the pole width is a minimum for circuit breakers of the same and higher electrical ratings and which have the same or similar profile configuration. The minimum modulus circuit breaker is typically designed to be used in the same panel board as circuit breakers of twice the width, similar profile and same ratings. The circuit breaker described by Locher is distinct in that the ratio of its width to its height and breadth is low relative to circuit breakers of the same electrical ratings.

The existence of composition sheets in an electrical circuit breaker for providing electric arc cooling and quenching therefor is known. Also, the existence of a channel in an electrical circuit breaker for providing electric arc cooling and quenching therefor is known. However, the combination of the composition sheets, together with a channel, which combination yields synergistic results in an electrical circuit breaker, was not heretofore known.

3. Statement in Accordance with 37 CFR 1.56

In accordance with the provisions of 37 CFR 1.56, the following patented art may be of interest.

| U.S. Pat. No. | Patentee |
|---|---|
| 2,428,254 | Walle |
| 2,654,815 | Laverty |
| 2,768,264 | Jones et al. |
| 2,830,158 | Coleman |
| 3,043,938 | Daly |
| 3,327,080 | Meinders |
| 4,217,472 | Gryctko et al. |

Walle, U.S. Pat. No. 2,428,254 discloses a circuit breaker having an arc chute covered with a layer of electrically insulating heat refractory material. With regard to various modifications of circuit breakers depicted in FIGS. 1–6 thereof (FIG. 7 is applied to an insulating support), no electrically conductive runner for the arc is provided.

Laverty, U.S. Pat. No. 2,654,815 discloses an electric circuit interrupter with various forms of housing. One form of housing, depicted in FIGS. 1 and 2, is constructed of metal, and forms an arc chamber which surrounds or encloses contacts as closely as is mechanically feasible. Another form, depicted in FIGS. 3 and 4, is a contact housing, or arc chamber, which, with the exception of one end wall, is made up of sheets of fibre; no end wall opposite end wall 22' is provided. Yet another form, depicted in FIGS. 5–8, includes a housing with side walls provided with inner fibre linings with extension of a lining through the top wall, so that there are fibre pieces adjacent the side edges of the contacts. Still another form, depicted in FIGS. 9–11, includes an arrangement of a metallic strip having a central portion forming an end wall and portions extending at right angles thereto to form top and bottom portions, together with a pair of fibre side plates.

Jones et al., U.S. Pat. No. 2,768,264, states that it is objects of their invention to provide an arc-suppressing shield having improved arc-suppressing characteristics, and to produce a molding composition which can be employed to mold switch-enclosures, fuse enclosures, or the like having improved arc-suppressing qualities. Jones et al. discloses compositions for suppressing arcs; the subject matter of said patent is incorporated herein by reference.

Coleman, U.S. Pat. No. 2,830,158, discloses a circuit breaker including a fixed contact disposed in a chamber formed within a recess of a base. A mechanism is provided for actuating a pivotal contact arm cooperating with the fixed contact. An atmospherically insulated sealed lining forms arc extinction means for the chamber, the lining retaining pressurized gases therein to suppress the arc, and isolating such gases from erosive contact with the actuating mechanism during all positions of the pivotal arm.

Daly, U.S. Pat. No. 3.043,938 relates to means for suppressing arcs incident to the separation of contacts in an electric switch. Plates are stamped from fiber insulating sheet material which have the property of powdering away under the heat of an electric arc and also of tending to suppress the arc more quickly. "This property has been well known for many years and need not be further explained".

Meinders, U.S. Pat. No. 3,327,080 discloses an arc chute which is provided with means for cooling the exhaust gases expelled from the top of the stack of plates. Such means take the form of hollow baffle members which are supported by perforated insulating members.

Gryctko et al., U.S. Pat. No. 4,217,472, discloses a circuit breaker having an arc chute. The arc chute includes a plurality of metal arc plates held in closely spaced face-to-face relationship by staked side protrusions which are received by positionning apertures in relatively rigid insulating side members. A cap constructed of folded insulating sheet material closes the rear of the arc chute and extends forward adjacent a portion of the main planar section of the last arc plate.

SUMMARY OF THE INVENTION

The narrowness of minimum modulus circuit breakers, as referred to hereinabove, dictates a thin walled housing which frequently demands the use of expensive, high strength plastic compounds, particularly when high, short circuit, interruption capacity is to be achieved. The use of expensive, high strength plastic substantially reduces economy that is sought in a minimum modulus circuit breaker.

U-shaped steel channels, which may be plated, for use in arc chambers of low voltage circuit breakers are commonly used to improve short circuit interruption capacity. Such channels vary in shape; they can be slotted, embossed and formed in various configurations suitable for various applications.

Likewise, sacrificial materials formed from composition sheets of material as described in U.S. Pat. No. 2,768,264 are used in arc chambers to expend arc energy, thereby diminishing impending damage that would otherwise occur when an arc is drawn between contacts upon their separation in response to a high fault current.

Though sacrificial materials have been used in combination with a plurality of arc plates (see discussion of Gryctko et al. patent, supra.), use of arc plates in a circuit breaker increases the number of parts therein, particularly when used in combination with a molded part, or a pair of flat parts, made of the sacrificial material.

Another object of this invention is to suppress the arc and obviate subsequent damage in high ampere versions of circuit breakers of the style described in the foregoing Locher patent by employing a new and improved combination of commercially available sacrificial material and an arc chamber channel as herein described.

Yet another object of this invention is to achieve high short circuit interruption capacity in high ampere rated versions of circuit breakers of the style described in the foregoing Locher patent by combination of the aforementioned arc chamber channel and sacrificial material in a circuit breaker housing made primarily of urea formaldehyde molding compound.

In accordance with one embodiment of the invention, the improvement comprises the combination of a pair of composition sheets and a channel in a circuit breaker. The breaker includes two electroconductive elements between which an arc may form. At least one of the elements is supported from a molded insulated housing which has a pair of opposing interior surfaces, each of the surfaces having an opposing formed recess extending along and close to the arc-path between the electroconductive elements. The housing is rigid and possessed of sufficient structural strength to be self-supporting. Each of the composition sheets resides alongside a respective opposing surface and is held in place within a respective formed recess. The sheets include material comprising a water-insoluble binder and an arc suppressing substance selected from the class consisting of the oxide and hydrates of aluminum and magnesium. The binder constitutes at least ten percent of the composition. The channel, providing electric arc cooling and quenching within the circuit breaker, is an integral, generally U-shaped member forming a base and opposing side walls. One end of the opposing side walls has extended widths thereby providing a pair of enlarged side wall surfaces for engaging with and being held by the composition sheets. Both ends of the base are formed with extending tabs for engaging molded features of an interior surface of the molded housing. Thus, the extending tabs and the composition sheets are adapted to space the channel away from the interior surfaces of the housing, exposing the surfaces of the channel which are not in contact with the sheets. The base has an arrangement of venting holes therein. The composition sheets physically contact the extending widths of the channel but physically do not engage a majority of the length of the channels. The composition sheets, in addition to having arc suppression characteristics, also support the channel away from the molded housing, thereby helping exhaust gages produced during arcing to vent both through the venting holes and along the exposed surfaces of the channel. The sheets further thermally insulate the chute from the housing.

In accordance with certain features of the invention, the arc-suppressing substance can be one of the aforesaid hydrates and can constitute between five and ninety percent of the combination. The binder can be inorganic, with the arc-suppressing substance being one of the foregoing oxides and constituting between ten and ninety percent of the composition. The composition can comprise about seventy percent of the arc-suppressing substance, about fifteen percent of asbestos, and about fifteen percent of a binder. The binder can be organic, with the arc-suppressing substance being an aluminum compound. The binder can be organic, with the arc-suppressing substance being one of the foregoing hydrates. The binder can be organic, with the arc-suppressing substance being an aluminum hydrate. The channel can be steel. The circuit breaker can further include a vent passage within the breaker housing exterior to the channel, with the housing having molded projections therein located at the vent passage, and in proximity to the holes to provide cooling surfaces, but spaced away from the holes sufficiently to provide passage of explusive gases.

BRIEF DESCRIPTION OF THE DRAWING

Other objects, advantages, and features of this invention, together with its construction and mode of operation, will become more apparent from the following description, when read in conjunction with the accompanying drawing, in which.

DESCRIPTION OF PREFERRED EMBODIMENT(S)

Figure 1:
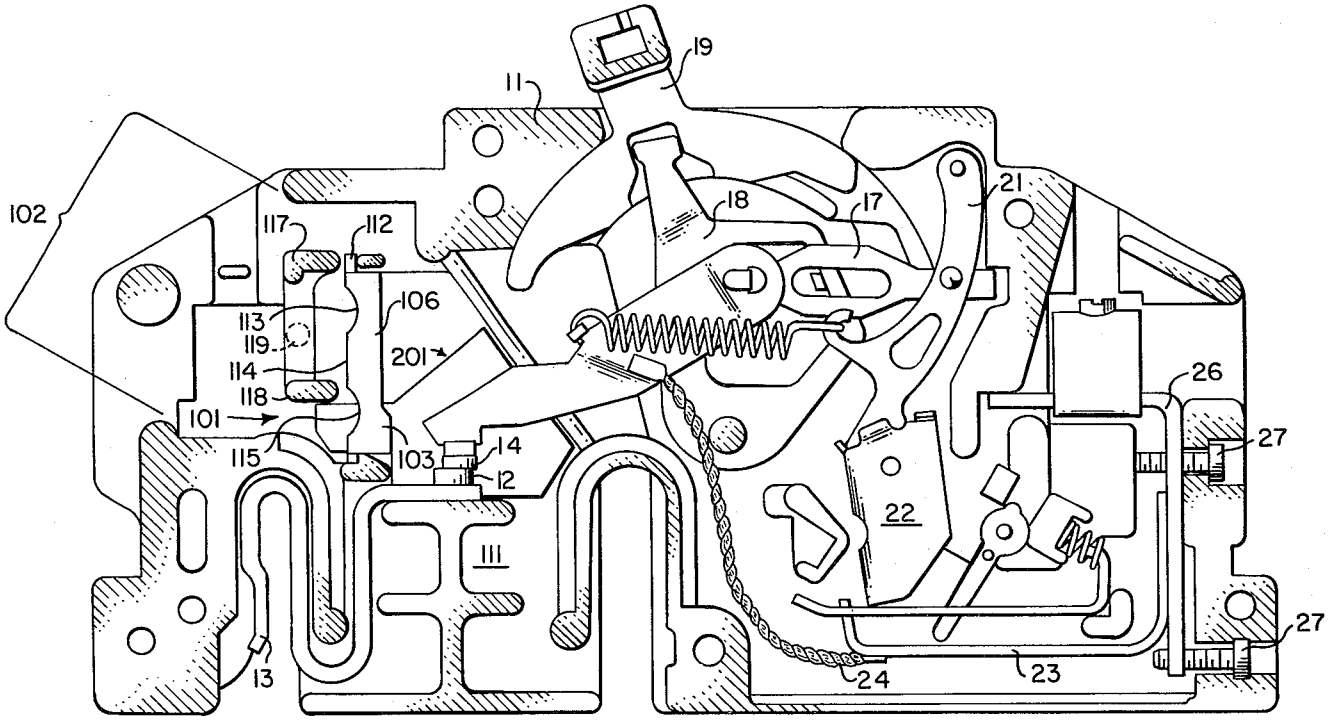
FIG. 1 is a view of a circuit breaker, with the cover removed, depicting the internal workings of such circuit breaker together with one embodiment of a channel and a pair of composition sheets (only one of which is shown for simplicity of illustration) in accordance with this invention.
Figure 7:
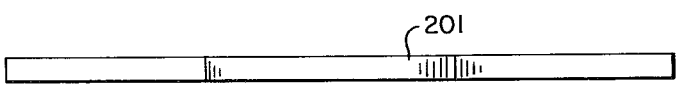
FIGS. 5, 6, and 7 are side, front, and end views, respectfully, of a composition sheet as depicted in FIG. 1, the other composition sheet being substantially identical thereto.
Figure 5:
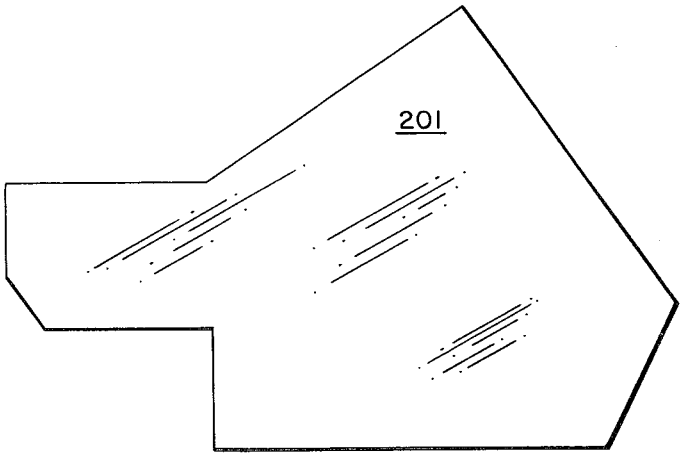
Figure 6:
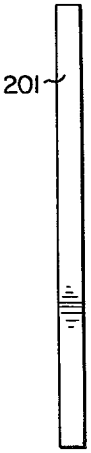
Figure 4:
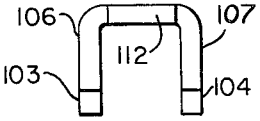
FIG. 4 is an end view of the channel depicted in FIGS. 1 through 3 inclusive.
Figure 3:
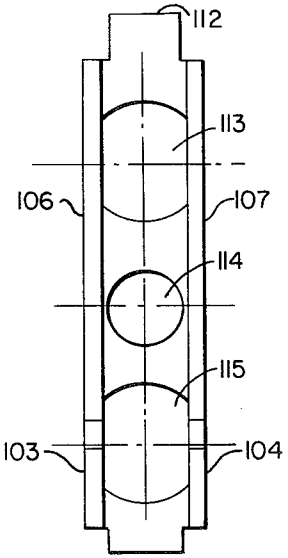
FIG. 3 is a front view of the channel as depicted in FIGS. 1 and 2, looking toward the base of the member.
Figure 2:
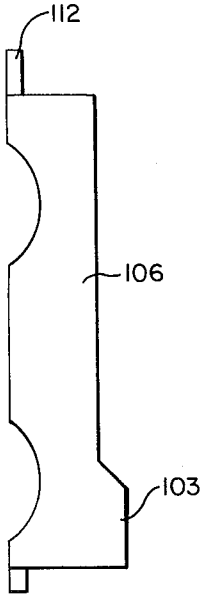
FIG. 2 is a side view of the channel depicted in FIG. 1.

Referring to FIG. 1, there is depicted a circuit breaker switch mechanism mounted in a case including a body 11 (with the cover plate removed) of a type such as shown and described in U.S. Pat. No. 3,114,023 to Locher. Typically, such a sircuit breaker includes a fixed contact 12 which is coupled to a bus clip 13. The switch mechanism includes a moving contact 14 carried on a contact arm 16, a pivot arm 17, a switch applicator 18, a finger member 19, a trigger arm 21, a latch lever 22, and a thermal trip member 23. A flexible conductor 24 is connected between the contact arm 16 and the thermal trip member 23, the trip member being spot welded to a conductor 26 fixed in the body by screws 27—27.

The operation of the trigger arm 21, the latch lever 22, and the thermal trip member 23 is the same as set forth in the Locher patent. When current through the switch exceeds a predetermined value for a predetermined time, the thermal member 23, which is ordinarily a bimetal strip, bends in a counterclockwise direction, freeing the latch lever 22 for counterclockwise rotation, which in turn frees the trigger arm 21, thereby moving the switch to the tripped or open circuit position. As the contacts 12 and 14 separate (i.e., "open"), an arc tends to occur.

The incorporation of a channel and a pair of composition sheets into a circuit breaker, in accordance with the invention, provides electric arc cooling and quenching, as will become more apparent hereinafter.

An integral, U-shaped steel channel 101 (see FIGS. 2-4) is placed in close proximity (see FIG. 1) to the contacts 12, 14, along a line approximately tangential to a path through which the moving contact and the end of the moving contact carrier 16 move during short circuit openings. As will be more apparent from a view of FIG. 1, the channel 101 occupies an area between the moving contact path and an arc chamber vent 102. Referring to FIGS. 1-4, one end of the channel is provided with extended widths to its sidewalls 106, 107, respectively, thereby providing a pair of enlarged sidewall surfaces 103, 104 for engaging with and being held by composition sheets 200—200, as will become apparent from a further reading of the specification. Each end of the base of the channel 101 is provided with a tab 112—112 for engaging a molded feature of an interior surface of the molded housing 11. Thus, the extending tabs 112, and the composition sheets 200 (via the enlarged sidewall surfaces 103, 104), space the channel 101 away from the interior surfaces of the molded housing 11, thereby exposing surfaces of the channel 101 not in contact with the sheets 200. The base has an arrangement of venting holes 113, 114, 115, therein.

Sacrificial barrier material, sold in sheet form by the Glastic Corporation under the designation UTR, is used in the preferred embodiment to partially line the opposing interior surfaces of the molded insulated housing 11, and is held in place within respective opposing formed recesses extending along and close to the arc-path between the fixed contact 12 and the moving contact 14. The material is cut, or stamped, to the shape as indicated in FIGS. 5-8 to form composition sheets 200—200. The two composition sheets 200—200 (or "liners") are held apart from one another and against the interior surfaces of the molded housing 11 by the steel channel 101 and the contact mounting portion of the bus connector clip 13. The two portions of molded housing 11 and cover (not shown) are riveted together, trapping the channel 101, the bus connector clip 13, and the composition sheets or liners 200—200, therein.

The profile features of the liners, or composition sheets 200—200, against which the channel 101 acts to separate them, are small in area, and touch only a fraction of the length of the outside portions of the opposing sides 106, 107 of the channel 101. Accordingly, the remaining outside portions of the opposing sides 106, 107 of the channel 101 are spaced away from the interior surfaces of the molded housing by at least the thickness of the UTR liners 200—200. The space thereby created exposes the outer surfaces of the channel 101 and adjacent wall areas of the arc chamber (i.e., interior surfaces of the housing 11). These exposed areas and the space therebetween serve as cooling surfaces annd vent passages, respectively, for hot gases, vapors and particles produced by an arc drawn between the contacts upon their opening in response to a high fault current.

Further, there is an arrangement of holes 113, 114, 115 in the channel 101 and of molded projections 117, 118, 119 in the walls of the housing 11 that protrude into the vent area. The holes 113, 114, 115 provide additional passages for expulsion of hot gases, vapors and particles from the arc chamber through the channel 101; the molded projections 117, 118, 119 located in the vent passage and near the holes 113, 114, 115 provide additional cooling surfaces. The quantity, size, and location of holes and molded projections for the preferred embodiment are shown in FIGS. 1-4.

In the past, were one to use an arc chute in a 30 ampere circuit breaker (of the minimum modulus type), or composition liners in a 30 ampere circuit breaker (but not both the channel and the composition liners, together), the circuit breaker housing would not rupture. With only the channel, or with only the composition liners (but not both), in a 40 ampere circuit breaker, the circuit breaker housing would rupture. With both a channel, and the composition liners, in a 40 or 50 ampere circuit breaker, the housing does not rupture.

In high ampere circuit breakers (50 amperes, for example), phenolic housings have been used. However, they have a tendency to "track" (i.e., the surface material of the housings, changing to carbon, become conductive) when "burned" (i.e., the circuit breaker housing "burns" from the heat generated upon excitation of the breaker). Alternatively, glass filled polyester housings do not track; disadvantageously, they are very expensive to manufacture. Desirably, urea is preferred for use in circuit breaker housings because it does not track and because urea is relatively inexpensive. Urea does not convert to carbon; urea ablates during a blast. It is desirable to produce narrow circuit breakers for high volume, residential use which can withstand high short circuit currents; with urea as a housing (which does not track after it has been exposed to very high temperatures), rupture can be prevented by practicing the teachings of this invention: that is, by the combination of a channel plus the composition sheets.

The UTR material, supplied by Glastic Corporation, is produced under U.S. Pat. No. 2,768,264 (now expired). The material is arc suppressing, tending to quench any arc that forms, thereby reducing the energy represented by its existence. Through the use of such material in this invention, a urea housing can be protected from being ruptured by a blast.

As indicated herein, the invention resides in the combination of the composition sheet material with the channel. The composition material, in addition to having arc suppressing characteristics, supports the channel away from the breaker housing (thereby helping in venting the gases through the holes of the channel and around the sides of the channel), and insulates the channel from the housing wall. In another sense, the invention resides in the combination of a ⅜ inch wide circuit breaker with the composition sheets and channel. (An R38 circuit breaker, a GTE catalog item, has a standard width of three-eighths inch.)

Other modifications, changes, deletions, and the like may be performed without departing from the spirit and scope of this invention, it being the intent that this invention be limited solely by the scope of the appended claims.

The subject matter of U.S. Pat. No. 2,768,264, issued Oct. 23, 1956 to P. W. Jones et al., entitled "ARC-SUPPRESSING DEVICE" is incorporated herein by reference.

What is claimed is:

1. In a circuit breaker including two electroconductive elements between which an arc may form, a molded insulated housing having a pair of opposing interior surfaces with each of said surfaces having an opposing formed recess extending along and close to the arc-path between said electroconductive elements, at least one of said electroconductive elements being supported from said molded housing, said molded housing being rigid and possessed of sufficient structural strength to be self-supporting, the improvement comprising the combination of a pair of composition sheets, each said sheet residing alongside a respective said opposing surface and held in place within a respective said formed recess, said composition sheets including material comprising a water-insoluble binder and an arc suppressing substance selected from the class consisting of the oxides and hydrates of aluminum and magnesium, said binder constituting at least ten percent of the composition; and a channel for providing electric arc cooling and quenching within said circuit breaker comprising an integral, generally U-shaped member forming a base and opposing side walls having a length from one end to an opposite end, said one end of said opposing side walls having extending widths thereby providing a pair of enlarged side wall surfaces for engaging with and being held by said composition sheets, each of said one end and said opposite end of said base being formed with an extending tab for engaging a molded feature of an interior surface of said molded housing, whereby said extending tabs and said composition sheets are adapted to space said channel away from said interior surfaces of said molded housing, thereby exposing surfaces of said channel not in contact with said sheets, said base having an arrangement of venting holes therein, and wherein said composition sheets physically contact said extending widths of said channel but physically do not engage a majority of said length of said channel whereby said composition sheets, in addition to having arc suppression characteristics, also support said channel away from said molded housing, thereby helping exhaust gases produced during arcing to vent both through said venting holes and along said exposing surfaces of said channel, said sheets further insulating said channel thermally from said housing.

2. The combination as recited in claim 1 with the addition that said arc-suppressing substance is one of said hydrates and constitutes between five and ninety percent of the composition.

3. The combination as recited in claim 1 with the addition that said binder is inorganic, said arc-suppressing substance being one of said oxides and constituting betfween ten and ninety percent of the composition.

4. The combination as recited in claim 1 with the addition that said composition comprises about seventy percent of said arc-suppressing substance, about fifteen percent of asbestos, and about fifteen percent of a binder.

5. The combination as recited in claim 1 with the addition that said binder is organic, said arc-suppressing substance being an aluminum compound.

6. The combination as recited in claim 1 with the addition that said binder is organic, said arc-suppressing substance being one of said hydrates.

7. The combination as recited in claim 1 with the addition that said binder is organic, said arc-suppressing substance being an aluminum hydrate.

8. The combination as recited in claim 1 wherein said channel is steel.

9. The circuit breaker as recited in claim 1 further including a vent passage within said breaker housing exterior to said channel, said housing having molded projections therein located at said vent passage, and in proximity to said holes to provide cooling surfaces, but spaced away from said holes sufficiently to provide passage of expulsive gases.

* * * * *